US005364071A

United States Patent [19]

Lu

[11] Patent Number: 5,364,071

[45] Date of Patent: Nov. 15, 1994

[54] SCISSOR JACK

[76] Inventor: Chung-Tai Lu, No. 1, I-Hsin Street, Shui Shang Hsiang, Chia-I Hsien, Taiwan, Prov. of China

[21] Appl. No.: 156,739

[22] Filed: Nov. 24, 1993

[51] Int. Cl.[5] ..... B66F 3/00

[52] U.S. Cl. ..... 254/8 B; 254/124; 254/93 H

[58] Field of Search ..... 254/126, 124, 122, 120, 254/8 R, 8 B, 8 C, 9 R, 9 B, 9 C, 10 R, 10 B, 10 C, 93 H

[56] References Cited

U.S. PATENT DOCUMENTS

| | | | |
|---|---|---|---|
| 2,937,850 | 5/1960 | Winkler et al. | 254/8 R |
| 3,806,093 | 4/1974 | Itazu | 254/124 |
| 4,681,299 | 7/1987 | Siebert | 254/8 R |

*Primary Examiner*—Robert C. Watson

*Attorney, Agent, or Firm*—Morton J. Rosenberg; David I. Klein

[57] ABSTRACT

A scissor jack includes a base, an oil reservoir, a pumping unit, an oil pressure cylinder, two lift arm units, a connecting rod provided between a lower arm of each lift arm unit and the top of a piston rod of the oil pressure cylinder, a handle provided to operate the pumping unit to send the oil in the reservoir to the oil pressure cylinder to move the two lift arm units up for lifting an object on the jack, two rollers fixed at both ends of a shaft sustained at an intermediate portion of each lower arm to sit on the ground when the lift arm units are lowered down to the lowest position to roll on the ground, and a spring being provided between an upper arm and each lower arm for stabilizing going-down movement of the lift arm units.

2 Claims, 4 Drawing Sheets

SCISSOR JACK

BACKGROUND OF THE INVENTION

A conventional scissor jack shown in FIG. 4 includes a handle 11 with the help of a pipe member 12 for pressing oil from an oil storing cylinder 13 into an oil pressure cylinder 15 mounted on a base 14 so that a piston rod may lifted up and then connecting rods 16, 16 are raised up to push lift arm units 17, 17 for raising up an object.

The conventional scissor jack has drawbacks as follows:

1. As rollers are not: provided under the base for moving around the scissor jack, the jack is not easy for moving on the ground.
2. The lift arm units may not be stabilized in moving down because of too heavy weight of an object to be lowered or unstable flowing speed of oil back in a reservoir.
3. The reservoir is separately combined with the base, not convenient for assemblage.

SUMMARY OF THE INVENTION

The present invention has been devised to offer a kind of scissor jack improved to get rid of the above-mentioned drawbacks.

Two rollers are attached on both ends of a shaft sustained in each lower arm of two lift arm units for helping secure rising movement of the lift arm units, and in addition, the rollers rest on the ground when the jack is lowered to the original (lowest) position to support the jack so as to move the jack on the ground, but leave the ground gradually to let the base support the jack when the lift arm units are raised up by a piston rod of an oil pressure cylinder.

A spring is provided between a shaft of each two rollers and an upper arm of each lift arm unit to stabilize going-down movement of the lift arm units.

BRIEF DESCRIPTION OF DRAWINGS

The invention will be better understood by reference to the accompanying drawings, wherein.

DESCRIPTION OF THE PREFERRED EMBODIMENTS

Figure 1:
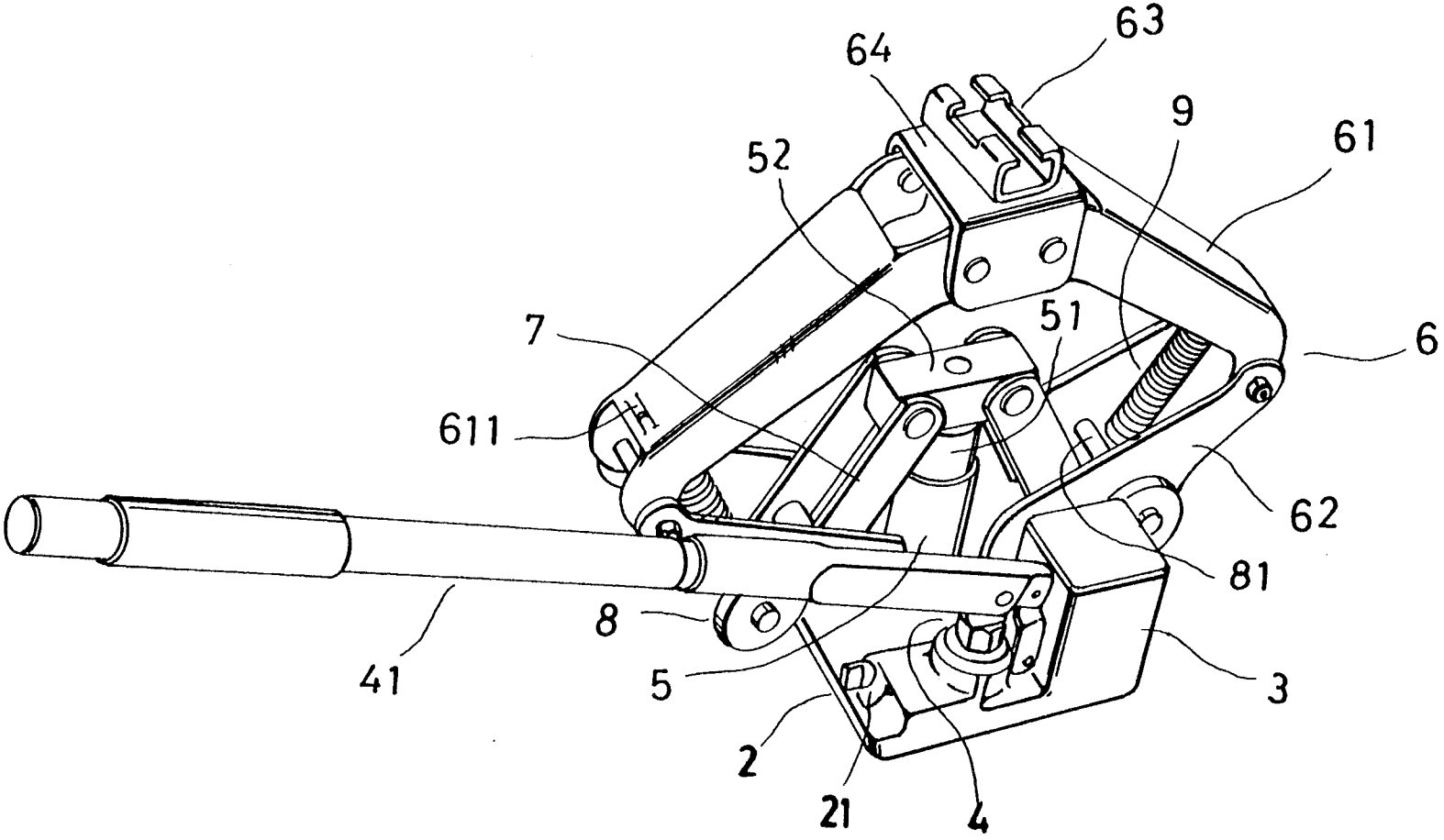
FIG. 1 is a perspective view of a scissor jack in the present invention.
Figure 2:
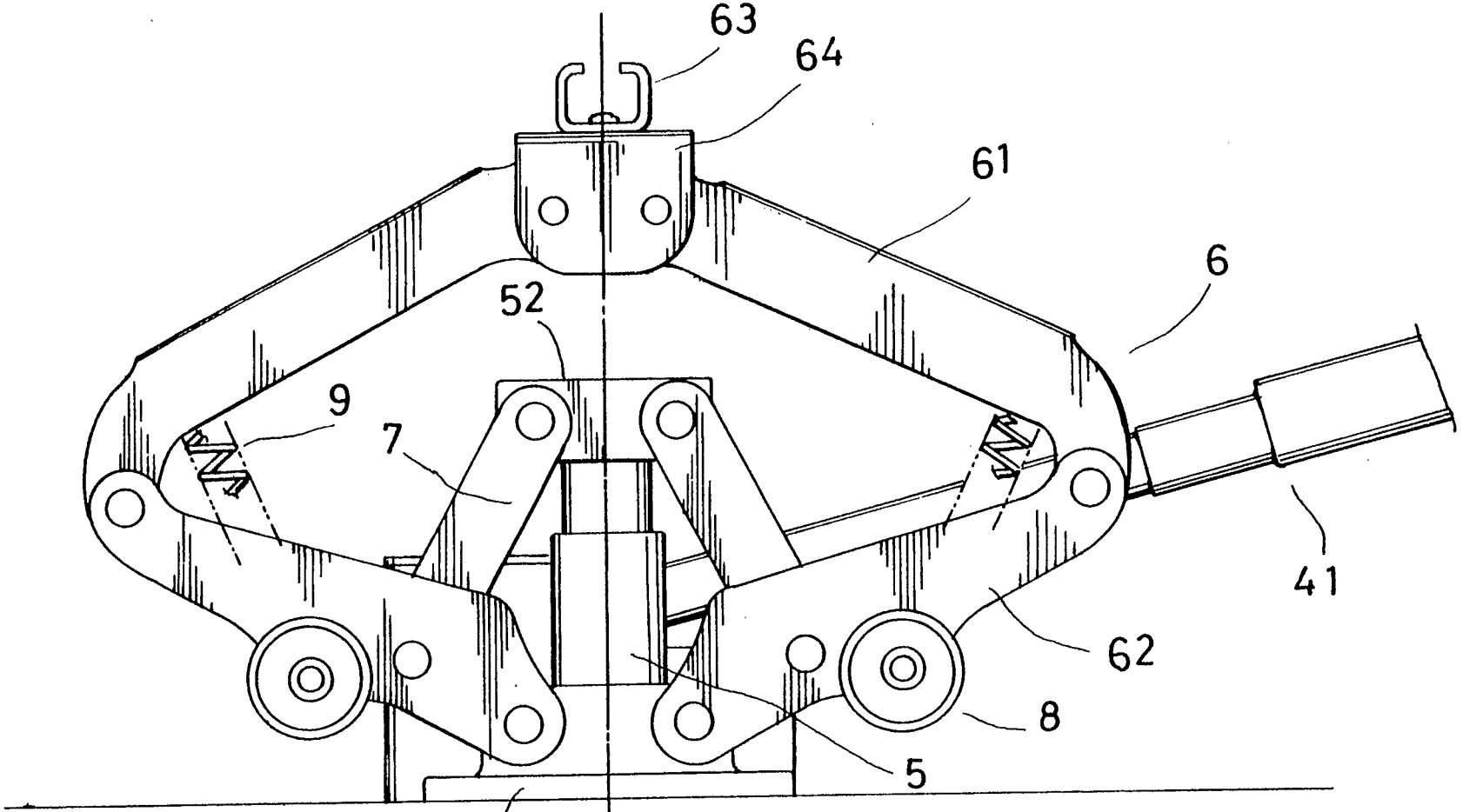
FIG. 2 is a side view of the scissor jack in the present invention.

A scissor jack in the present invention, as shown in FIG. 1, includes a base 2, an oil reservoir 3, a pumping unit 4, an oil pressure cylinder 5, two lift arm unit 6, 6, two linking rods 7, 7, four rollers 8 and two springs 9,9 combined together.

The base 2 has an oil pipe and a pressure relief valve fixed with the oil pipe provided in an interior. The oil reservoir 3, the pumping unit 4 and the oil pressure cylinder 5 are mounted on the base 2.

The pumping unit 4 has a handle 41 manually moved to push the oil stored in the oil reservoir 3 to flow through the oil pipe in the base 2 into the oil pressure cylinder 5 to lift up a piston rod for raising up the two lift arm unit 6, 6.

The two lift arm units 6, 6 each have an upper arm 61, a lower arm 62 pivotally connected with the upper arm 61, a connecting socket 64 provided between the two upper arm 62, an actuating member 63 provided on the connecting socket 64, a connecting rod 7 provided between an end of each lower arm 62 and a stationary block 52 set on top of the piston rod 51 so that the two lift arm units 6, 6 may be lifted up or lowered down by function of the oil pressure cylinder 5 for lifting up or down an object.

The above mentioned structure is the same as a conventional scissor jack, and the main feature of the present invention is additional provision of four rollers 8 fixed on both ends of a shaft sustained at an intermediate portion of the lower arm 62 of the lift arm units 6, 6, and a spring 9 provided between a shaft of the roller 8 and a dent line 611 below the upper arm 61.

The rollers 8 help balance the weight on the lift arm units in going-up-and-down movement by leaving the ground when the lift arm units are lifted up or lowered down, allowing the base 2 sitting on the ground, and the oil reservoir 3 is formed together with the base 2 as integral.

Figure 3:
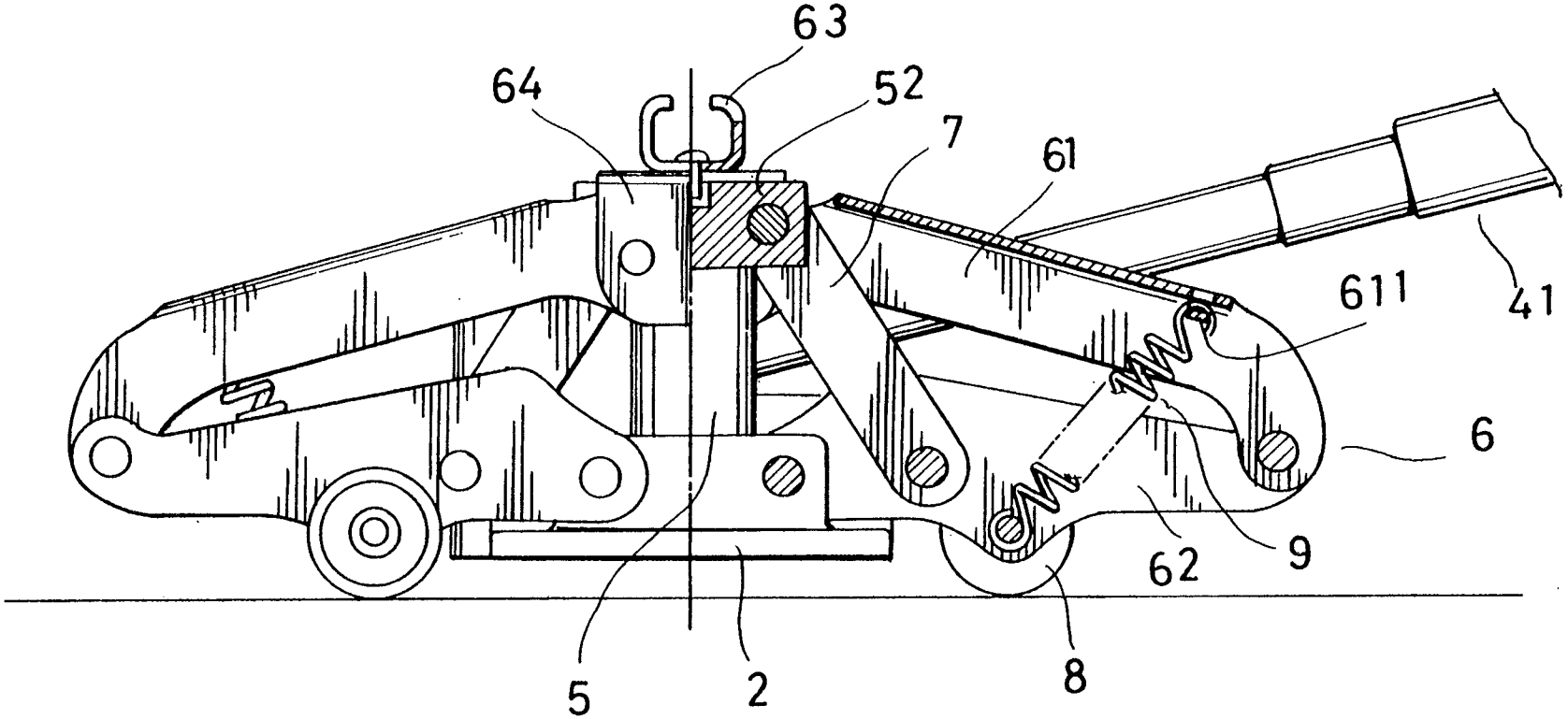
FIG. 3 is a side view of the scissor jack in the present invention, showing the jack lowered to the original (lowest) position; and, FIG. 4 is a side view of a conventional scissor jack.
Figure 4:
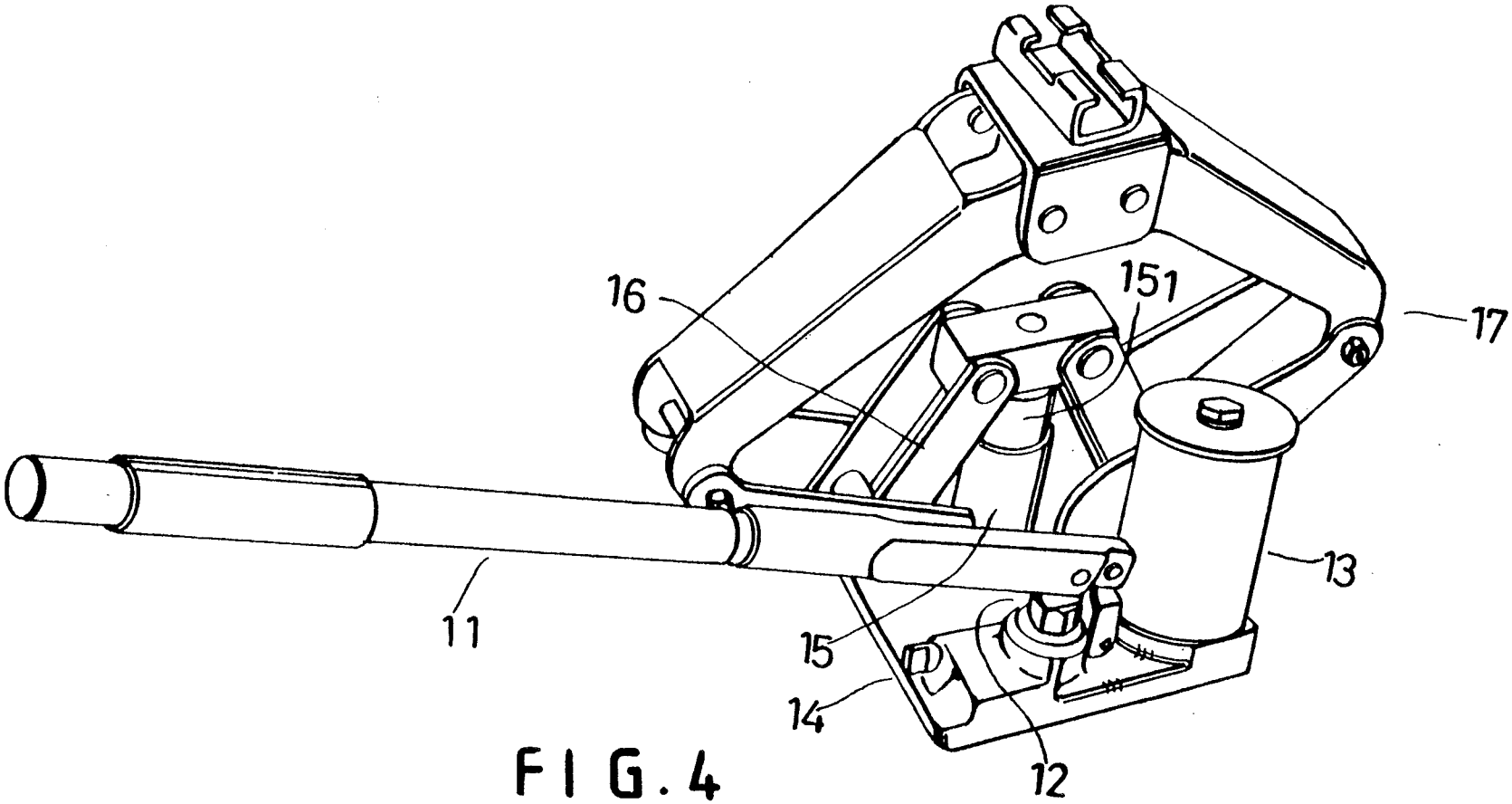
FIG. 4 (PRIOR ART)

FIG. 3 showns the jack lowered down to the original (the lowest) position, letting the four rollers 8, 8 sitting on the ground supporting the jack and letting the base raised up a little and leaving the ground so as to enable the rollers 8 move on the ground. Then the jack can be moved around to where it is needed.

While the preferred embodiments of the invention have been described above, it will be recognized and understood that various modifications may be made therein and the appended claims are intended to cover all such modifications which may fall within the spirit and scope of the invention.

What is claimed is:

1. A scissor jack having a base member, an oil reservoir mounted on said base member, a pumping unit for pumping oil from the oil reservoir to an oil pressure cylinder having a piston rod, a pair of lift arm units rotatably mounted to said base member, each of said pair of lift arm units including a pair of lift arm upper members and a pair of lift arm lower members, said lift arm upper members rotatably secured to respective lift arm lower members and said lift arm lower members being rotatably secured to said base member, a pair of connecting units, each of said connecting units having a pair of linking rods rotatively coupled on opposing ends rotatively coupled to an upper section of said piston rod and said lift arm lower members, wherein the improvement comprises:

a pair of roller units rotatively mounted to said lift arm lower members, each of said roller units having a pair of roller members joined each to the other by a roller member shaft, and a pair of spring members, each of said spring members having opposing ends respectively coupled to a detent in said lift arm upper member and said roller member shaft.

2. The scissor jack as recited in claim 1 where said oil reservoir is formed integrally with said base member.

* * * * *